US007675252B2

(12) United States Patent
Chen et al.

(10) Patent No.: US 7,675,252 B2
(45) Date of Patent: Mar. 9, 2010

(54) METHODS OF CONSTRUCTING A BETATRON VACUUM CHAMBER AND INJECTOR

(75) Inventors: Felix K. Chen, Newtown, CT (US); Joyce Wong, Pasadena, CA (US); Gary W. Corris, Newtown, CT (US); Stephen Balkunas, Brookfield, CT (US); Zilu Zhou, Needham, MA (US); James G. Haug, Danbury, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 515 days.

(21) Appl. No.: 11/431,317

(22) Filed: May 10, 2006

(65) Prior Publication Data

US 2006/0261759 A1 Nov. 23, 2006

Related U.S. Application Data

(60) Provisional application No. 60/683,833, filed on May 23, 2005.

(51) Int. Cl.
*H05H 7/00* (2006.01)

(52) U.S. Cl. ..... 315/504; 315/507; 315/500; 315/111.51; 315/111.61

(58) Field of Classification Search ..... 315/504, 315/507, 500, 111.51, 111.61
See application file for complete search history.

(56) References Cited

U.S. PATENT DOCUMENTS

| | | | | |
|---|---|---|---|---|
| 2,545,958 A * | 3/1951 | Kerst | 313/62 |
| 2,697,167 A * | 12/1954 | Kerst | 315/504 |
| 2,822,490 A * | 2/1958 | Scag | 378/137 |
| 3,879,679 A | 4/1975 | Mourier | |
| 4,739,214 A * | 4/1988 | Barr | 313/362.1 |
| 5,122,662 A * | 6/1992 | Chen et al. | 250/269.3 |
| 6,201,851 B1 * | 3/2001 | Piestrup et al. | 378/121 |

FOREIGN PATENT DOCUMENTS

| | | | |
|---|---|---|---|
| GB | 632139 | 11/1949 | 39/56 |
| GB | 1150337 | 4/1969 | |
| GB | 1268868 | 3/1972 | |

OTHER PUBLICATIONS

Ohnishi, T. et al. "Possible application of carbon nanotubes to the field emission electron source for portable betatrons." Nuclear Instruments and Methods in Physics Research A (2004): pp. 16-24.

United Kingdom Intellectual Property Office, Examination Report under Section 18(3) for Application No. GB0609720.8, 60.1558 GB NP, Oct. 5, 2009, pp. 1-3.

* cited by examiner

*Primary Examiner*—Nikita Wells
(74) *Attorney, Agent, or Firm*—James M. McAleenan; Helene Raybaud; Brigid M. Laffey

(57) ABSTRACT

A betatron structure having a donut-shaped vacuum chamber, wherein the vacuum chamber is made up of two or more pieces bonded together; an injector positioned within the vacuum chamber; and two or more magnets positioned to the outside of the vacuum chamber. A method of manufacturing a betatron structure, including: (a) fabricating two or more pieces; (b) positioning an injector on one of the two or more pieces; and (c) bonding the two or more pieces such that when bonded, the substrates form a hollow donut-shaped chamber.

39 Claims, 3 Drawing Sheets

400

METHODS OF CONSTRUCTING A BETATRON VACUUM CHAMBER AND INJECTOR

CROSS-REFERENCE TO RELATED APPLICATIONS

The present application claims the benefits of priority to U.S. Provisional Application Ser. No. 60/683,833, entitled "Methods of Constructing a Betatron Vacuum Chamber and Injector," filed May 23, 2005, which are incorporated herein by reference in its entirety.

FIELD OF THE INVENTION

The present invention relates to a method and apparatus for a compact circular magnetic induction accelerator (betatron), and more particularly, to simpler and more efficient betatron vacuum chamber and injector design fabricated on the microscale.

BACKGROUND OF THE INVENTION

Nuclear tools have been used for several decades to determine the density of earth formations surrounding a borehole. Conventional density tools consist of a source of gamma-rays (or X-rays), at least one gamma-ray detector and shielding between the detector and the source, so that only scattered gamma-rays are detected. During density logging, gamma-rays from the tool source travel through the borehole, into the earth formation. The nuclear density tools rely on the Compton scattering of gamma-rays in the formation for the density measurements.

Due to size limitations and high gamma-ray intensity and energy requirements (more than about 500 keV for a monoenergetic source and an endpoint energy more than about 1 MeV for a Bremsstrahlung spectrum), downhole gamma-ray density tools have traditionally used radioactive chemical sources. However, the use of chemical sources creates a host of logistic and political issues. For example, there is a high level of liability associated with the handling and use of chemical sources. As a result, there are many governmental and safety controls required when handling, transporting, storing, and disposing of tools using chemical sources. Accordingly, there has been an effort in recent years to replace chemical sources with non-chemical, electronic sources (Bremsstrahlung).

While electrostatic machines can provide the required energy level, they are generally not suited for this borehole application. Likewise, linear RF machines can provide high intensity gamma-rays, however, their size and weight make them difficult to implement for borehole applications. In addition, they tend to be cost prohibitive. Induction machines, such as betatrons, are tempting non-chemical gamma-ray sources. However, the vacuum chambers of betatrons have been traditionally constructed of glass using hand made glass blowing techniques. This traditional manufacturing technique requires the employment of highly skilled artisans. Accordingly, betatrons of this type are not reproducible in a manner consistent enough for mass production. In addition, due to the many design problems (as described in part below), they have not been successfully implemented.

The circular shaped vacuum chamber and injector play vital roles in the successful operation of a borehole betatron. The chamber provides a vacuum environment wherein the electron beam accelerates. It is shaped like a donut that fits between two poles of the Betatron magnet and encompasses the center core of the magnet. Inside the chamber, a small electron gun, or injector, emits electrons at the beginning of, and in synchronization with, each acceleration cycle. A small fraction of the emitted electrons that fall within the magnet acceptance are trapped, accelerated to the full energy, and finally, directed toward a target, where some electrons collide with the target electrons. As a consequence of these collisions Bremsstrahlung radiation (x-rays) is emitted from the target. Most electrons emitted from the injector at the beginning of the acceleration cycle are not trapped and, lacking sufficient energy to penetrate the chamber wall, simply land on the inside surface of the chamber. On a bare insulating surface such as glass, excessive wall charge may lead to the premature disintegration of the accelerating beam due to the electrostatic field generated by the trapped charges. To alleviate this problem, the interior surface of the glass accelerator chamber is coated with a resistive layer having conductivity sufficient to bleed the wall charge to the ground without causing significant eddy current to retard the changing magnetic field. The appropriate resistivity of this layer is approximately 100-1000 Ω per square. The application of this resistive coating to traditional glass blown vacuum chambers has proven quite challenging. Accordingly, coating the inside of the accelerator chamber with an appropriate vacuum-compatible material that can survive electron beam bombardment is one of the many impediments to the development of a viable borehole betatron.

Only those electrons that fall within the magnet acceptance may be trapped and accelerated. Because magnet acceptance is generally very small, the injector alignment and position, which have significant impact on trapping efficiency, are very critical. The injector (at the back of which the target can be placed) is traditionally mounted at one end of a long cantilever arm, which consists of multiple conductive metal strips attached to the electrodes on the injector. The other ends of the metal strips are attached to a vacuum electrical feedthrough. The assembly is then inserted into the vacuum chamber through a long protruding port with a glass-to-metal joint and welded into place. The proper positioning and alignment of the injector attached at the end of a long cantilever arm inside the traditional glass blown vacuum chamber are very challenging. Accordingly, the mounting and alignment of the injector/target are two additional difficult design issues.

Proper operation of the betatron requires that the chamber be under vacuum. This presents additional challenges to the fabrication of the structure using traditional custom glass blown techniques. A second vacuum port must be provided in the glass structure to allow for the creation of a vacuum. The presence of these ports puts additional geometrical constraint on coil and magnet design.

Accordingly, it is an object of the present invention to provide a vacuum chamber design that is simpler to manufacture and has improved reproducibility.

It is another object of the present invention to provide a betatron vacuum chamber whose interior surface has the required conductivity.

It is yet another object of the present invention to provide a betatron vacuum chamber that allows simpler and more efficient alignment of the injector/target.

SUMMARY OF THE INVENTION

The present invention provides a gamma-ray source fabricated on the microscale. The betatron structure of the present invention is comprised of: (a) a donut-shaped vacuum chamber, wherein the vacuum chamber is comprised of two or more pieces bonded together (forming the walls of the structure); (b) an injector positioned within the vacuum chamber; and (c) two or more magnets positioned to the outside of the vacuum chamber. Optionally, the target may also be positioned within the vacuum chamber. The betatron includes an injector which may be designed to be integral with, mounted on, or bonded to at least one of the two or more pieces or may be bonded to the pieces. The two or more pieces are comprised of glass, Pyrex, silicon based materials, ceramics, composites, or a combination thereof. These pieces can be coated and/or doped to achieve the desired resistivity within the chamber. Such coating may be performed prior to bonding of the pieces. In addition, these pieces may be custom shaped to form the vacuum chamber by using various techniques, including ultrasonic or water jet machining, mechanical machining, grinding, forming, blast or photo etching, MEMS (micro-electro-mechanical system) manufacturing techniques or combinations thereof. The pieces may be bonded together using various techniques including brazing, anodic bonding, frit sealing, ultrasonic welding, or fusion, or combinations thereof. While electrical feedthroughs may be formed in the wall of the structure, such feedthroughs may not be necessary if the bonding is performed using metallic brazing techniques. In this case, the metallic braze may function as the electrical connection.

If feedthroughs are formed, they should be sealed using any variety of techniques, including brazing, anodic bonding, frit sealing, ultrasonic welding, or fusion, or combinations thereof.

The emitter of the injector may be a cold emitter (such as a field-emitting array and carbon nano-tube based emitter) or a thermionic emitter (such as a dispenser cathode, a $LaB_6$ cathode or a tungsten cathode).

Further features and applications of the present invention will become more readily apparent from the figures and detailed description that follows.

DETAILED DESCRIPTION OF THE INVENTION

A betatron (gamma-ray source) is comprised of two main components: a modulator and a betatron structure. The modulator includes a power conditioning unit and a beam control unit. The betatron structure includes a magnet (shown in FIGS. 2 and 3), a vacuum chamber (shown in FIGS. 1, 2, and 3), and an injector (shown in FIG. 1). It is noted that the target may be integrated or combined with the injector structure.

Figure 1:
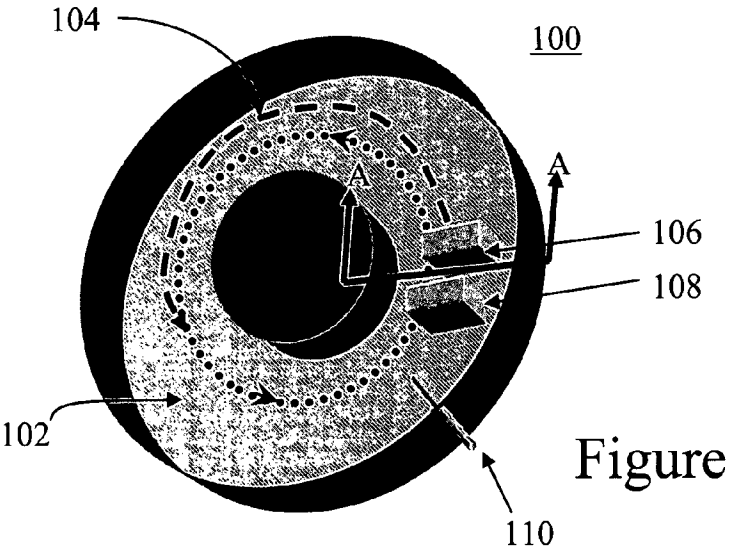
FIG. 1 is a schematic of a vacuum chamber.

FIG. 1 shows a general schematic of the betatron structure 100, having a donut-shaped vacuum chamber 102. An injector 106 and target 108 are positioned inside the accelerator chamber 102. It is noted that while injector 106 and target 108 are shown here as two different elements, one skilled in the art would recognize that the injector and target may be designed as a common element. Electrons injected into the chamber 102 by the injector 106 are trapped therein by the magnetic field created by magnets 212*a*, 212*b* (see FIG. 2). The electrons follow a generally circular orbital path 104 until they reach the desired energy level. Electrons that achieve the desired energy are ejected from the orbit to impact target 108 to produce a flux of high energy X-ray photons. Various electrical feedthroughs 110 can also be provided, passing through the wall of the chamber to allow electrical connection to the injector. Cross sections of this configuration are shown in FIGS. 2, 3, and 4.

Figure 3:
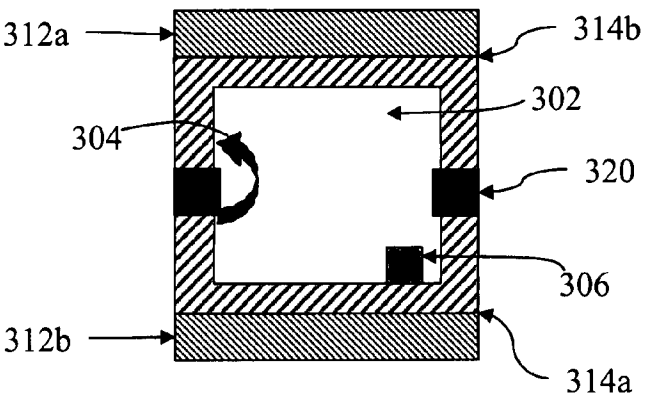
FIG. 3 is a cross section of a second embodiment of the vacuum chamber in accordance with the present invention.
Figure 2:
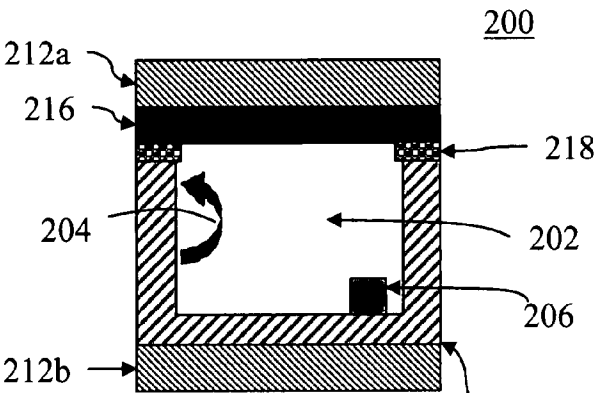
FIG. 2 is a cross section of a first embodiment of the vacuum chamber in accordance with the present invention.
Figure 4:
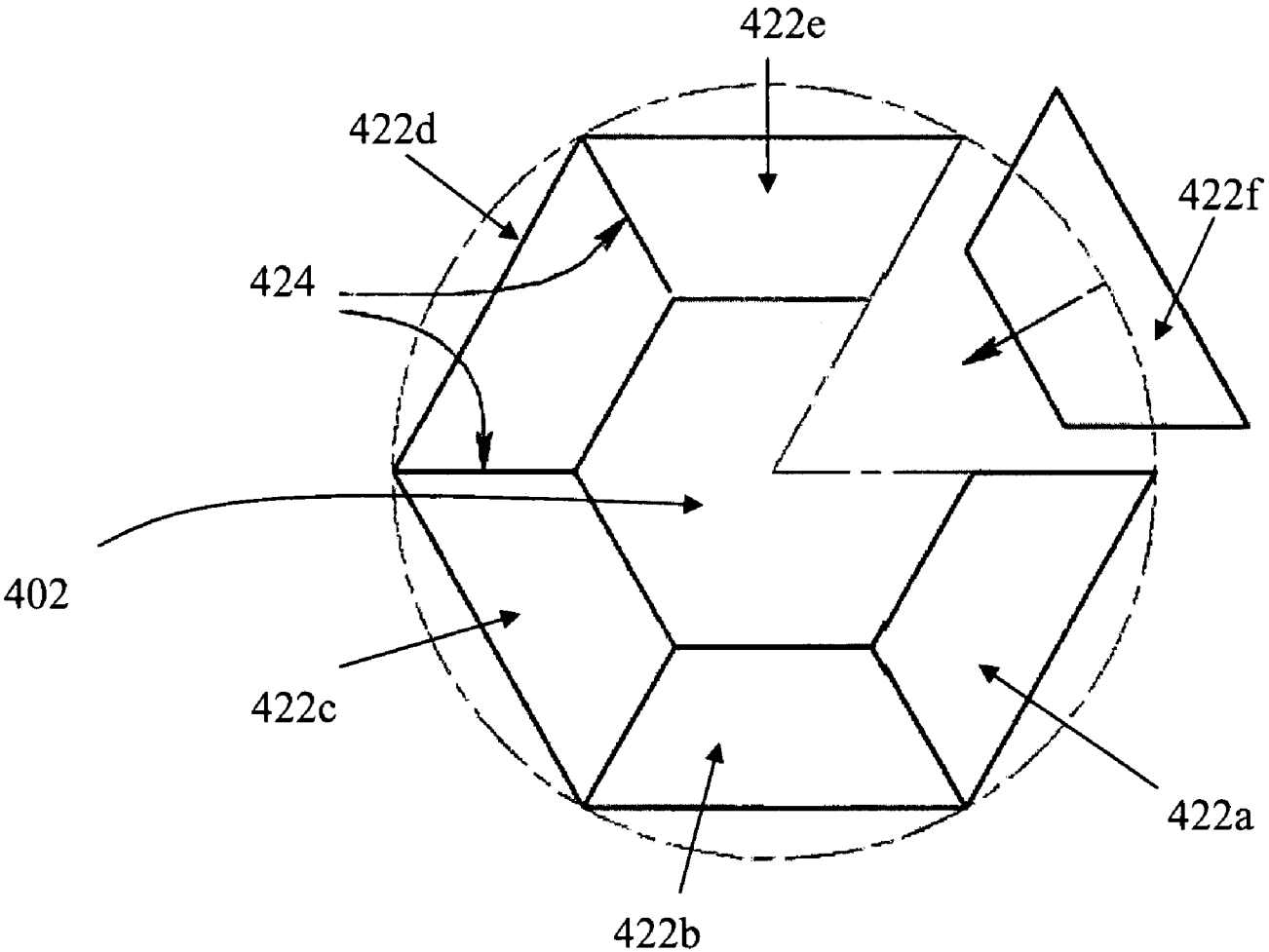
FIG. 4 is a cross section of a third embodiment of the vacuum chamber in accordance with the present invention.

In accordance with the present invention and as shown in FIGS. 2, 3, and 4, the vacuum chamber is comprised of two or more pieces. While FIGS. 2, 3, and 4 show two approximately equally sized pieces, other sized and shaped pieces may be used. The two-piece (or multipiece) design allows for easier and more accurate injector alignment because alignment is performed before the pieces are bonded. Further, the need for a vacuum port is eliminated because all of the pieces that form the final structure are assembled and sealed under vacuum conditions. Because the parts are machined at a microscale, they are more precise and reproducible as compared to traditional custom glass blown techniques. Alternatively, a vacuum port may be utilized in construction for ease of manufacturing.

In accordance with the present invention, the donut-shaped vacuum chamber is constructed of any material (1) that can be custom-shaped and (2) whose conductivity can be customized. Suitable materials include glass, Pyrex, silicon based materials, ceramics, composites, or a combination thereof.

These pieces may be shaped using ultrasonic or water jet machining, mechanical machining, grinding, forming, blast or photo etching, or using MEMS manufacturing techniques (including surface or bulk silicon micromachining techniques, or a combination of these techniques). The pieces are bonded to form the vacuum chamber using any variety of bonding techniques under vacuum conditions, including brazing, anodic or fusion bonding, frit sealing, ultrasonic welding, or combinations thereof.

Suitable materials are ones that can be tailored to any conductivity to meet the operation requirements, such as by coating, doping or a combination thereof. The multipart design of the structure as seen in FIGS. 2, 3, and 4) allows easier coating of the material as this may be performed prior to bonding the pieces. For use as a gamma-ray source, an appropriate resistive coating should have a surface resistivity of about 100-1000 Ω per square.

The injector 106, 206, 306 may include two or more electrodes separated by insulators. Both the electrodes and insulators may be fabricated using machining techniques suitable for precision machining of very small structures, i.e. ultrasonic machining, blast etching, or using MEMS technology. The electrodes and insulators are then bonded into a layered structure with a suitable bonding technique. The electrodes are made of a conductive material, including highly doped Si or any suitable metal that is compatible with the machining precision and bonding requirements. The insulators may be glass, Pyrex, or any other suitable insulating material with a sufficient dielectric strength and can be bonded to the electrodes. The electron source, or emitter, may be an integral part of the electrode (the cathode), or it may be a separated component that is installed after various electrodes have been bonded. The electron source may be either a cold emitter such as a field-emitting array or carbon nano-tube based emitter, or it may be a thermionic emitter such as a dispenser cathode, a $LaB_6$ cathode or a tungsten cathode.

In one variation 200 shown in FIG. 2 (which shows cross section A-A of FIG. 1), the vacuum chamber 202 is made of two parts: a top 216 and an open donut-shaped base 214. The glass top 216 and the Si base 214, with the injector already mounted and aligned inside the chamber, are then joined 218 using any of a variety of techniques. Magnets 212*a*, 212*b* are positioned outside the chamber and act to accelerate the electrons. For orientation purposes, the electron trajectory is shown as numeral 204.

In another variation 300, shown in FIG. 3, which also shows cross section A-A of FIG. 1, both pieces of the vacuum chamber 314*a*, 314*b* are made of doped Si and joined in vacuum with either direct Si-Si fusion bonding 320 or anodic bonding with a thin glass interface to form the chamber 302. Magnets 312*a*, 312*b* and electron trajectory 304 are also shown in FIG. 3.

In the designs of FIGS. 2 and 3, electrical feedthroughs to the injector can be either built into the Si or inserted through predrilled holes in the glass. The electrical feedthroughs (for receiving the electrical connections) can be made of glass or Si and metal pin construction and sealed to the vacuum chamber wall using one or more of fusion bonding, anodic bonding, frit sealing, or ultrasonic bonding. One skilled in the art would recognize that other techniques may be used to achieve favorable results.

Another variation 400 shown in FIG. 4 (again showing cross section A-A of FIG. 1) does not require embedded feedthroughs. The chamber 402 is constructed from several hollow Si tubes 422*a*, 422*b*, . . . 422*f* with approximately rectangular shaped cross-section. Both ends of the rectangular tube are cut to an angle such that when joined together they form a closed chamber. Joining takes place at both ends of the tube with a metallic braze 424 (i.e. $PdIn_3$). The joints also serve as electrical contacts provided they do not intercept the magnetic flux. It is noted that the hollow tubes may be made of ceramic structures (with coated interior surfaces and metallized ends). Alternatively, the same construction could be used with ceramic material, in which case the joints can serve directly as metallic feedthroughs.

The use of a compact betatron of the present invention can be used for a variety of applications, including non-destructive testing and screening, as a borehole source for density measurements, or other portable industrial applications.

Figure 5:
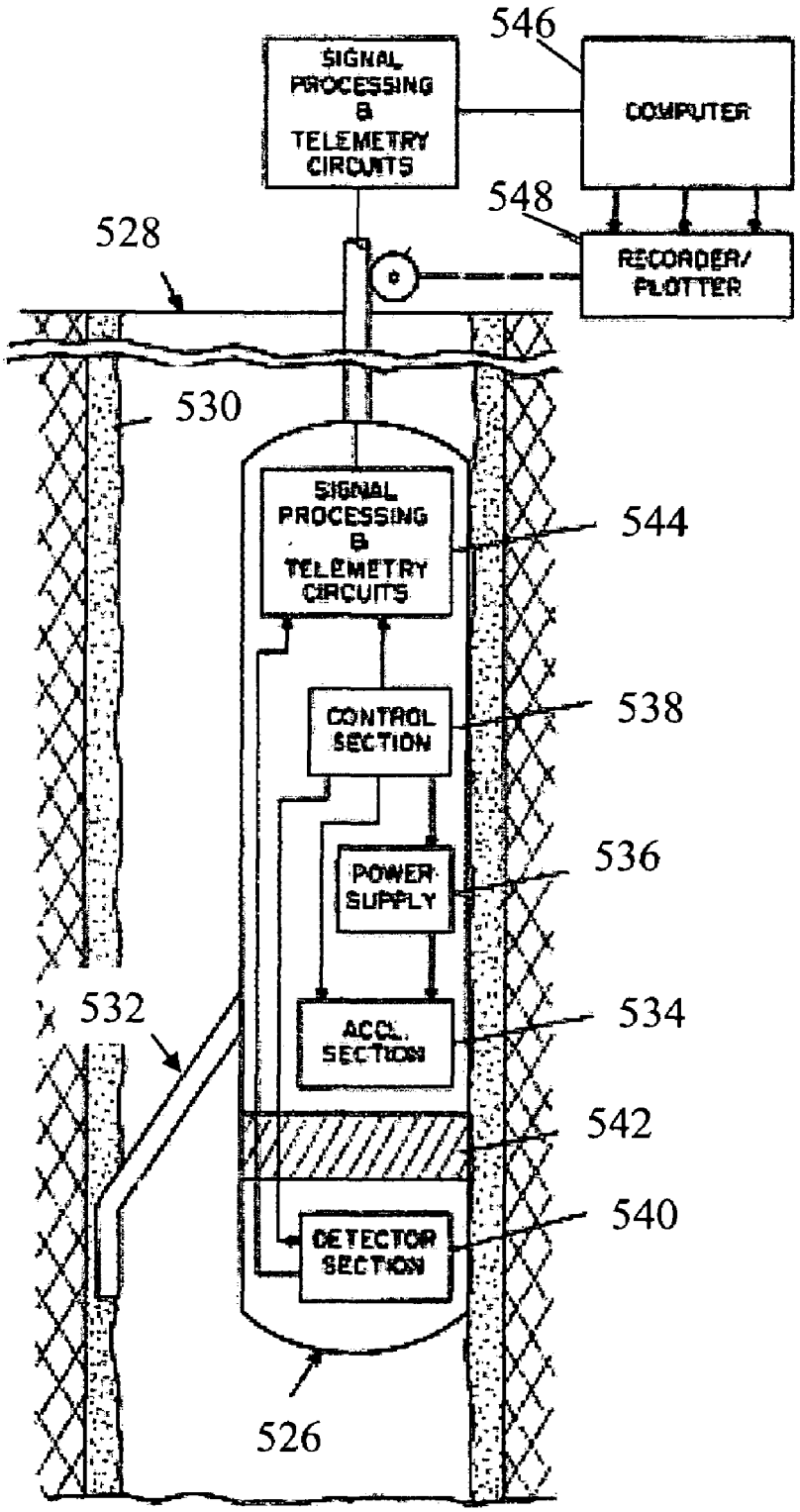
FIG. 5 is a schematic of a density logging tool useful for one application of the present invention.

Use of the source as a borehole source in a density logging tool is illustrated in FIG. 5. A downhole sonde 526 is shown suspended in an open hole 528 covered with mudcake 530. An articulated arm 532 urges the sonde 526 against the borehole wall. The sonde 526 includes an accelerator section 534 which contains the betatron and a power supply 536 and a control section 538 for the betatron. Other power supplies (not shown) may be provided as needed for the other downhole components, as is conventional. The control section 538 contains modulation circuits and other circuits needed to drive the betatron, and as known in the art (see for example, commonly owned U.S. Pat. No. 5,122,662, incorporated by reference herein in its entirety). A detector section 540 is spaced at different distances from the accelerator 534 and is shielded therefrom by a gamma-ray absorber 542. The detector section 540 preferably includes two or more gamma-ray detectors spaced at different distances from the accelerator 534. Both the control section 538 and the detector section 540 are connected to downhole signal processing and telemetry circuits 544. The circuits 544 are connected to a truck or skid-mounted computer 546 for processing of the detector data to calculate borehole and mudcake-compensated bulk density measurements. These measurements are output to a recorder/plotter 548, which makes the customary visual and/or tape log as a function of depth in the borehole. To that end, the recorder/plotter 548 is coupled to a cable-follower mechanism known in the art. One skilled in the art would recognize that an x-ray output monitoring device should be used to assist in performing a traditional density measurement.

While the invention has been described herein with reference to certain examples and embodiments, it will be evident that various modifications and changes may be made to the embodiments described above without departing from the scope and spirit of the invention as set forth in the claims.

What is claimed is:

1. A betatron structure comprising:

a vacuum chamber, wherein said vacuum chamber includes at least two or more pieces bonded together such that at least one of said two or more nieces is coated with a suitable resistive coating and at least one of said two or more pieces is coated and doped to a suitable conductivity;

an injector positioned within said vacuum chamber; and two or more magnets positioned to an outside of the vacuum chamber.

2. The betatron structure of claim 1, wherein a target is positioned within said vacuum chamber.

3. The betatron structure of claim 1, wherein said at least two or more pieces includes a material selected from the group consisting of glass, Pyrex, silicon based materials, ceramics, composites, or any combination thereof.

4. The betatron structure of claim 1, wherein at least one of said at least two or more pieces are coated with a suitable resistive coating.

5. The betatron structure of claim 1, wherein said at least two or more pieces are shaped using ultrasonic or water jet machining, mechanical machining, grinding, forming, blast or photo etching, MEMS manufacturing techniques or combinations thereof.

6. The betatron structure of claim 1, wherein said injector is an integral part of one of said at least two or more pieces.

7. The betatron structure of claim 1, wherein said injector is mounted on one of said at least two or more pieces.

8. The betatron structure of claim 1, wherein said injector is bonded to one of said at least two or more pieces.

9. The betatron structure of claim 1, wherein said at least two or more pieces are bonded together using brazing, anodic bonding, frit sealing, ultrasonic welding, or fusion, or combinations thereof.

10. The betatron structure of claim 9, wherein said bond is a metallic braze which functions as an electrical connection.

11. The betatron structure of claim 1, further comprising one or more electrical feedthroughs passing through at least one of said at least two or more pieces.

12. The betatron structure of claim 11, wherein said one or more feedthroughs are sealed.

13. The betatron structure of claim 12, wherein said seal is formed using anodic bonding, frit sealing, ultrasonic welding, or fusion, or combinations thereof.

14. The betatron structure of claim 1, wherein said injector includes an emitter.

15. The betatron structure of claim 14, wherein said emitter is a cold emitter.

16. The betatron structure of claim 15, wherein said cold emitter is selected from the group consisting of a field-emitting array and carbon nano-tube based emitter.

17. The betatron structure of claim 14, wherein said emitter is a thermionic emitter.

18. The betatron structure of claim 17, wherein said thermionic emitter is selected from the group consisting of a dispenser cathode, a $LaB_6$ cathode and a tungsten cathode.

19. A method of manufacturing a betatron structure, the method comprising:

a. fabricating two or more pieces such that said two or more pieces are coated with a suitable resistive coating and said two or more pieces are coated and doped to a suitable conductivity;

b. positioning an injector on one of said two or more pieces;

c. bonding said two or more pieces such that when bonded, the substrates form a hollow chamber; and d. positioning two or more magnets approximate to an outside of the hollow chamber.

20. The method of claim 19, further comprising positioning a target within said chamber.

21. The method of claim 19, further comprising bonding said injector to at least one of said two or more pieces.

22. The method of claim 19, wherein said two or more pieces are comprised of glass, Pyrex, silicon based materials, ceramics, composites, or a combination thereof.

23. The method of claim 22, wherein said at least one of two or more pieces are doped to a suitable conductivity.

24. The method of claim 19, further comprising shaping said two or more pieces using ultrasonic or water jet machining, mechanical machining, grinding, forming, blast or photo etching, MEMS manufacturing techniques or combinations thereof.

25. The method of claim 19, further comprising shaping said injector integral with one of said two or more pieces.

26. The method of claim 19, further comprising mounting said injector on one of said two or more pieces.

27. The method of claim 19, further comprising bonding said injector to one of said two or more pieces.

28. The method of claim 19, wherein bonding said two or more pieces includes using brazing, anodic bonding, frit sealing, ultrasonic welding, or fusion techniques, or combinations thereof.

29. The method of claim 19, further comprising shaping one or more electrical feedthroughs passing through at least one of said two or more pieces.

30. The method of claim 29, further comprising sealing said one or more feedthroughs.

31. The method of claim 30, wherein sealing includes using anodic bonding, frit sealing, ultrasonic welding, or fusion techniques, or combinations thereof.

32. The method of claim 19, wherein said injector includes an emitter.

33. The method of claim 32, further comprising forming a cold emitter on said injector.

34. The method of claim 33, further comprising forming a cold emitter selected from the group consisting of a field-emitting array and carbon nano-tube based emitter.

35. The method of claim 32, further comprising forming a thermionic emitter on said injector.

36. The method of claim 35, further comprising forming a thermionic emitter selected from the group consisting of a dispenser cathode, a $LaB_6$ cathode and a tungsten cathode.

37. The betatron structure of claim 2, wherein the target is positioned within the vacuum chamber so as to intercept ejected electrons from a magnetic field of the at least two or more magnets.

38. A betatron structure comprising:

a vacuum chamber, wherein the vacuum chamber is comprised of two or more pieces bonded together such that at least one of the two or more pieces is coated with a suitable resistive coating and at least one of the two or more pieces is coated and doped to a suitable conductivity;

an injector positioned within the vacuum chamber;

at least one target structured and arranged so as to be one of integrated or combined with the injector; and two or more magnets positioned to the outside of the vacuum chamber.

39. The betatron structure of claim 38, wherein the at least one target is positioned within the vacuum chamber so as to intercept ejected electrons from a magnetic field of the at least two or more magnets.

* * * * *